US008769766B2

(12) United States Patent
Hilton

(10) Patent No.: US 8,769,766 B2
(45) Date of Patent: Jul. 8, 2014

(54) APPARATUS, SYSTEM, AND METHOD FOR SELF-CLEANING HANDHELD DUST REMOVAL

(76) Inventor: Ronald N. Hilton, Holladay, UT (US)

( * ) Notice: Subject to any disclaimer, the term of this patent is extended or adjusted under 35 U.S.C. 154(b) by 627 days.

(21) Appl. No.: 12/854,690

(22) Filed: Aug. 11, 2010

(65) Prior Publication Data

US 2011/0036373 A1 Feb. 17, 2011

Related U.S. Application Data

(60) Provisional application No. 61/233,078, filed on Aug. 11, 2009.

(51) Int. Cl.
*A47L 5/24* (2006.01)
*A47L 5/26* (2006.01)

(52) U.S. Cl.
USPC ..... 15/344; 15/349; 15/50.2; 15/50.3

(58) Field of Classification Search
USPC ..... 15/49.1, 50.2, 50.3, 106, 300.1, 344, 15/354
See application file for complete search history.

(56) References Cited

U.S. PATENT DOCUMENTS

| | | | | |
|---|---|---|---|---|
| 1,268,963 | A * | 6/1918 | Gray | 15/320 |
| 2,239,183 | A * | 4/1941 | Willard | 15/322 |
| 2,910,721 | A * | 11/1959 | Burrage | 15/342 |
| 4,361,929 | A * | 12/1982 | Jinkins | 15/355 |
| 4,654,916 | A * | 4/1987 | Postonen et al. | 15/50.3 |
| 6,799,350 | B1 | 10/2004 | Gordon | |
| 7,251,857 | B2 | 8/2007 | Caruso | |
| 7,594,298 | B2 | 9/2009 | Greene | |
| 2006/0179607 | A1 | 8/2006 | Ptak et al. | |
| 2008/0086834 | A1 | 4/2008 | Schwarz et al. | |
| 2009/0172912 | A1 | 7/2009 | Knopow | |

* cited by examiner

*Primary Examiner* — Saeed T Chaudhry
(74) *Attorney, Agent, or Firm* — Kunzler Law Group

(57) ABSTRACT

An apparatus, system, and method are disclosed for self-cleaning dust removal. The apparatus may be provided with a brush housing 202 having an opening 204, one or more axles 206 disposed around the opening 204, and a plurality of brush fibers 208 emanating from the one or more axles 206 that rotate inward into the opening 204. In addition, the system may include a scraping edge 106, disposed around the opening 204, farther into the brush housing 202 than the one or more axles 206, that scrapes 1408 dust off of the brush fibers 208 as they rotate inward against the scraping edge 106, and a vacuum cleaner intake port 110 inside the brush housing 202 that draws 1410 dust from off and about the brush fibers 208 as they rotate inward 1406. The system may further include a handle 112 connected to the brush housing 202 and a switch 114.

6 Claims, 11 Drawing Sheets

APPARATUS, SYSTEM, AND METHOD FOR SELF-CLEANING HANDHELD DUST REMOVAL

CROSS-REFERENCES TO RELATED APPLICATIONS

This application claims priority to U.S. Provisional Patent Application No. 61/233,078 entitled "Apparatus, System, and Method for a Self-Cleaning Handheld Dust Remover" and filed on Aug. 11, 2009 for Ronald N. Hilton, which is incorporated herein by reference.

BACKGROUND

1. Field of the Invention

This invention relates to household cleaning appliances and more particularly relates to handheld dust removal tools.

2. Description of the Related Art

A number of tools and methods may be used to remove dust from household surfaces, such as a feather duster, a dust rag and the like. Materials may include ostrich feathers and other types of feathers, lamb's wool, other natural and synthetic fibers, and so forth. The dusting tool may be brushed across the household surface, wiping the dust from the surface and attracting the dust to the fibers. After a certain amount of usage, it then becomes necessary to clean the dust off of the dusting tool by shaking, beating, or rinsing the dust free. This cleaning is best performed away from the household environment so that the dust will not settle back onto the surfaces from which it was removed.

The attraction and retention of the dust by the fibers may be enhanced by spraying a moistening agent on the dusting tool or household surface. Nevertheless, it will still become necessary to clean the tool after its dust retention capacity has been reached. Otherwise, dust will simply be deposited back on the surface as the now-saturated tool moves the accumulated dust around.

Other potential approaches to dust removal involve moving air. A vacuum cleaner creates suction to draw the dust away from the surface. Vacuuming is not as effective on glossy surfaces where even a thin layer of dust is very evident, or on irregular surfaces where the proximity required for good suction is difficult to maintain without scratching or otherwise damaging the surface with the vacuum nozzle. Suction of the vacuum may be improved with a more powerful motor, but the associated weight and bulk would make it unsuitable for most household dusting. Another alternative would be to use compressed air to blow the dust off of the surface, but the dust will eventually settle back onto the same or another surface.

Variously configured rotating brushes may also be used. However, these may suffer from the same drawback as compressed air, removing the dust rapidly but simultaneously ejecting it in one or more directions only to settle back onto the various household surfaces. Also, similar to manual dusters and dust rags, they must be periodically cleaned when their dust retention capacity has been reached. A vacuum cleaner may be enhanced by a rotating brush as long as adequate suction is maintained to capture the ejected dust before it escapes into the surrounding environment. However, the same disadvantages apply to glossy and irregular surfaces as with vacuuming in general.

SUMMARY

From the foregoing discussion, it should be apparent that a need exists for an apparatus, system, and method to thoroughly remove dust from a variety household surfaces without reintroducing it into the household environment. Beneficially, such an apparatus, system, and method would be self-cleaning.

The present invention has been developed in response to the present state of the art, and in particular, in response to the problems and needs in the art that have remained intractable under currently available dust removal technology. Accordingly, the present invention has been developed to provide an apparatus, system, and method for self-cleaning dust removal that overcome many or all of the above-discussed shortcomings in the art.

The apparatus for self-cleaning dust removal is provided with a brush housing having an opening, one or more axles disposed around the opening in the brush housing, and a plurality of brush fibers emanating from the one or more axles that rotate inward about the one or more axles into the opening. The brush fibers may comprise microfibers, electrostatic fibers, polyester fibers, wool fibers, feathers, or the like.

The apparatus, in one embodiment, may include a scraping edge, disposed around the opening, farther into the brush housing than the one or more axles, that scrapes dust off of the brush fibers as they rotate inward against the scraping edge. The apparatus may be further configured, in one embodiment, with a vacuum cleaner intake port inside the brush housing that draws dust from off and about the brush fibers as they rotate inward.

In an embodiment, the opening may have a substantially polygonal shape. In a further embodiment, the one or more axles may be rigid and may be disposed along one or more substantially opposing pairs of sides of the polygonal shape of the opening. In a particular embodiment, the polygonal shape may be rectangular with the axles disposed along one pair of opposing sides.

In another embodiment, the opening may have a substantially circular shape. In a further embodiment, the one or more axles may be flexible and conform to the circular shape of the opening in one or more arcs. In one particular embodiment, the one or more axles may comprise two substantially semi-circular axles. In another particular embodiment, the one or more axles may comprise a single substantially circular axle.

A system of the present invention is also presented for self-cleaning dust removal. The system may be embodied by the foregoing apparatus, including the scraping edge and the vacuum cleaner, and further including a handle connected to the brush housing and a switch that activates and deactivates the system. In particular, the system, in one embodiment, may be handheld and battery-powered. In a further embodiment, the system may be rechargeable and include a recharging fixture.

The system may further include a removable handle extension connectable to the handle. In a further embodiment, the system may include a swivel joint between the handle and the handle extension. The system may also include a power cord and plug connected to the handle extension, wherein the handle extension provides power to the system.

A method of the present invention is also presented for self-cleaning dust removal. The method in the disclosed embodiments substantially includes the steps necessary to carry out the functions presented above with respect to the operation of the described apparatus and system. In one embodiment, the method may include providing a brush housing having an opening, one or more axles disposed around the opening in the brush housing, and a plurality of brush fibers emanating from the one or more axles. The functional steps may then include rotating the plurality of brush fibers inward about the one or more axles into the opening, scraping dust off of the brush fibers as they rotate inward against a scraping edge disposed around the opening, farther into the brush housing than the one or more axles, and drawing dust from off and about the brush fibers through a vacuum cleaner intake port into a dust receptacle having a replaceable filter as the brush fibers rotate inward. The method also may include instructing a user in performing the steps of unmounting one or more of the filter and the brushes and mounting one or more of a replacement filter and replacement brushes, wherein the one or more axles and the plurality of brush fibers comprise one or more replaceable brushes.

In a further embodiment, the method may include instructing a user in performing the steps of emptying the dust receptacle and cleaning one or more of the filter and the brushes, wherein the brushes and the filter respectively comprise the replacement brushes and the replacement filter.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
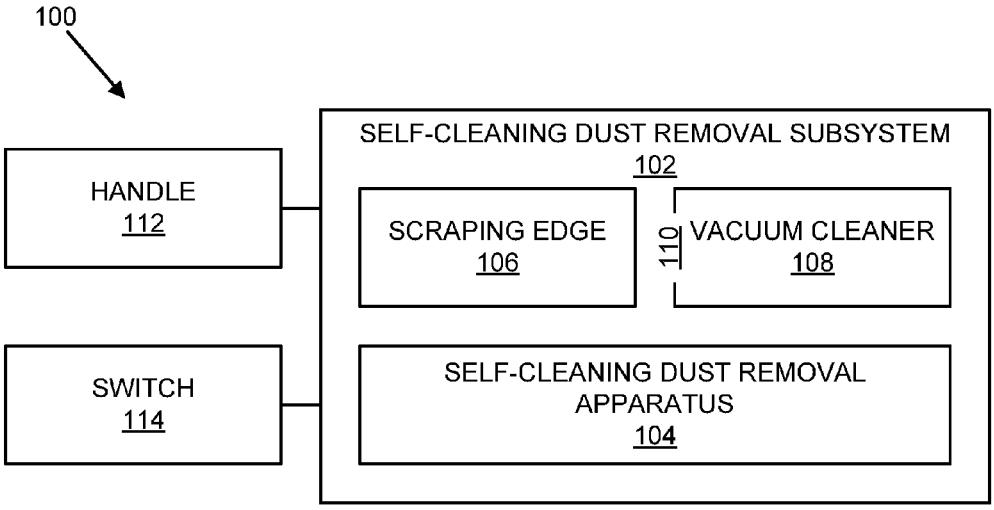
FIG. 1 is a schematic block diagram illustrating a system of the present invention.

FIG. 1 is a schematic block diagram illustrating a system 100 of the present invention, which may be referred to as a dust remover or a duster. The system 100 may comprise a self-cleaning dust removal subsystem 102 which in turn may comprise a self-cleaning dust removal apparatus 104, a brush scraper or scraping edge 106, and a vacuum cleaner 108. The apparatus 104 may remove and accumulate dust from a household or other environment, including a domicile, workplace, vehicle, and so forth. The scraping edge 106 may mechanically clean the accumulated dust from the apparatus 104. The vacuum cleaner 108 may aerodynamically clean and sequester the accumulated dust through an intake port 110 from returning into the household environment.

A handle 112 may be provided to permit handheld operation of the system 100. A switch 114 may be provided to manually or automatically activate and deactivate the system 100 as needed.

Figure 2:
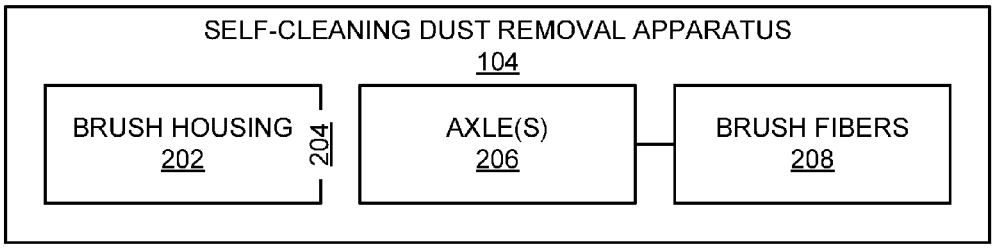
FIG. 2 is a schematic block diagram illustrating a self-cleaning dust removal apparatus according to the present invention.

FIG. 2 is a schematic block diagram illustrating the self-cleaning dust removal apparatus 104 according to the present invention. The apparatus 104 may comprise a brush housing 202 having an opening 204, one or more axles 206 disposed around the opening 204 in the brush housing 202, and a plurality of brush fibers 208 emanating from the one or more axles 206 that rotate inward about the one or more axles 206 into the opening 204.

In one embodiment of the system 100, the handle 112 may be connected to the brush housing 202. The scraping edge 106 may be disposed around the opening 204, farther into the brush housing 202 than the one or more axles 206, to scrape dust off of the brush fibers 208 as they rotate inward against the scraping edge 106. The vacuum cleaner 108 may have an intake port 110 inside the brush housing 202 that draws dust from off and about the brush fibers 208 as they rotate inward.

Figure 3:
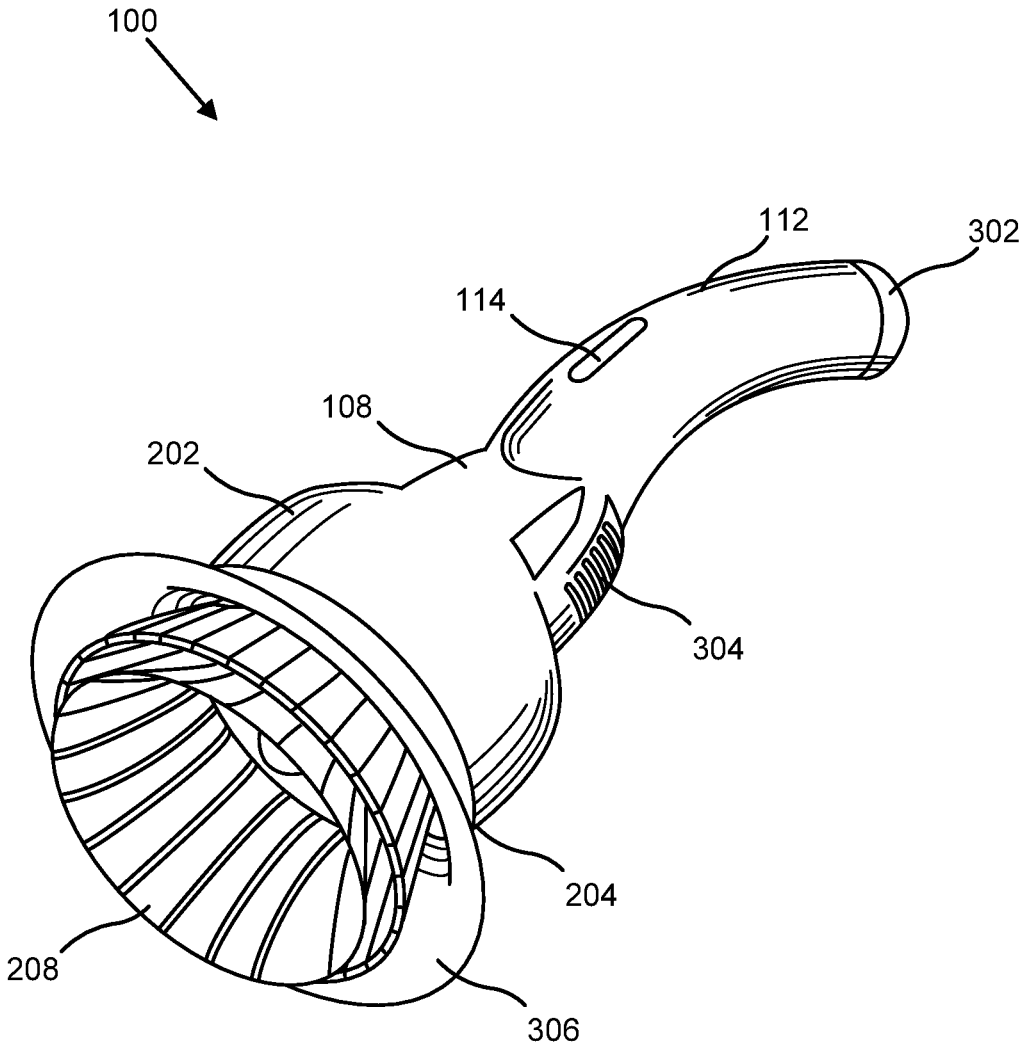
FIG. 3 is a perspective view illustrating one embodiment of a duster in accordance with the present invention.

FIG. 3 is a perspective view illustrating one embodiment of a duster 100 in accordance with the present invention. A battery cover 302 may be provided at the end of the handle 112 to allow battery replacement as needed. The switch 114 may be placed for convenient operation by a user's thumb while grasping the handle 112. The handle 112 may be curved or otherwise ergonomically shaped for user comfort and safety. Note that an exhaust port 304 is visible on the side of the vacuum cleaner 108. A front rubber attachment 306 may be provided to protect household surfaces from damage by direct contact with the opening 204 of the brush housing 202 which may be composed of a harder material such as rigid plastic. In the embodiment shown, the brush fibers 208 may be in the form of synthetic feathers or the like.

Figure 4A:
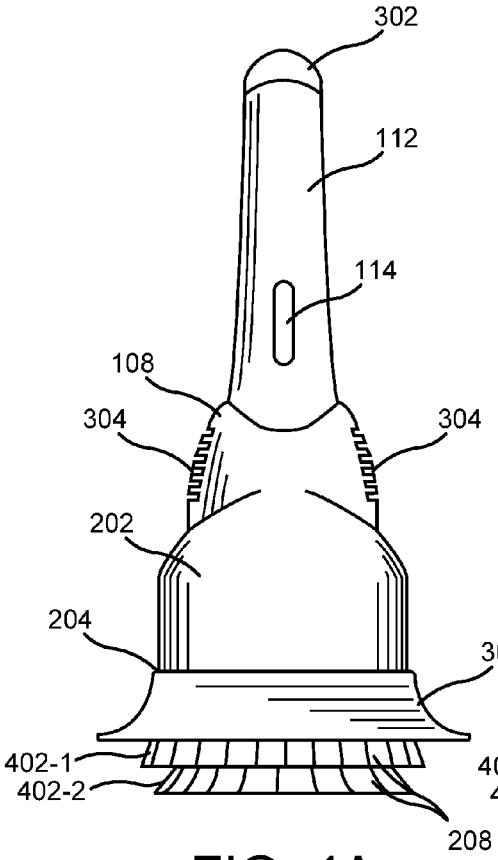
FIG. 4A is a top view further illustrating the duster of FIG. 3.

FIG. 4A is a top view further illustrating the duster 100 of FIG. 3. In this view, exhaust ports 304 may be seen on both sides of the vacuum cleaner 108. The synthetic feather brush fibers 208 may be seen to be grouped into rows, with a first row 402-1 and second row 402-2 being visible protruding beyond the front rubber attachment 306 around the opening 204. During operation, the successive rows 402 of brush fibers 208 sweep dust into the opening 204, where they are cleaned and then reemerge, again protruding beyond the front rubber attachment 306 to collect more dust.

Figure 4C:
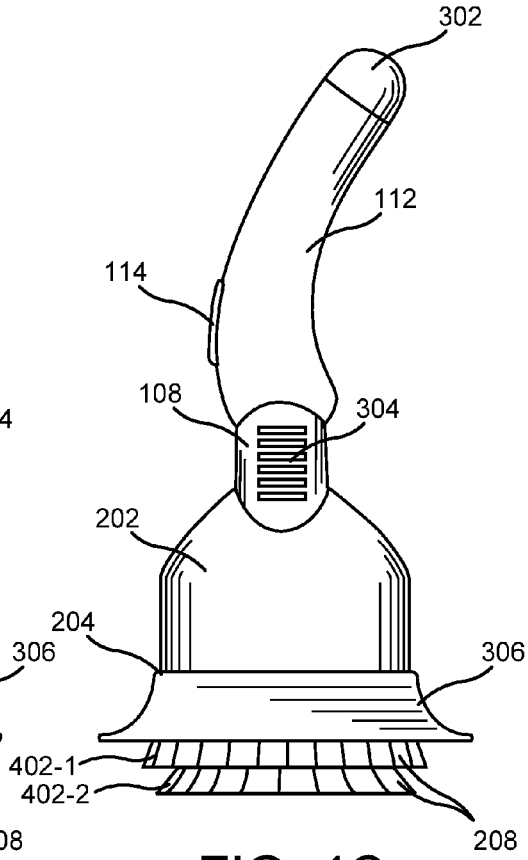
FIG. 4C is a side view further illustrating the duster of FIG. 3.
Figure 4B:
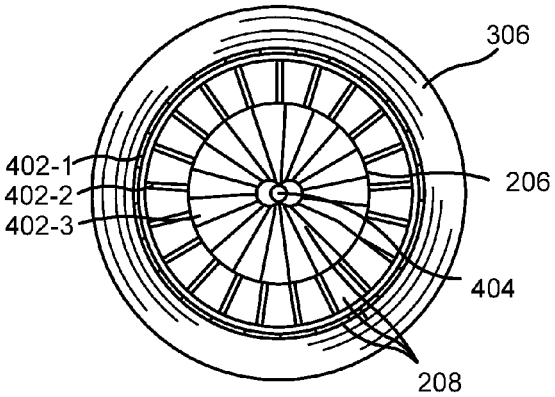
FIG. 4B is a front view further illustrating the duster of FIG. 3.

FIG. 4B is a front view further illustrating the duster 100 of FIG. 3. In this view, a third row 402-3 of brush fibers 208 may be seen, having been fully rotated about the axle(s) 206 toward a center point 404. From that center point 404, the row 402-3 of brush fibers may then re-expand outward against the scraping edge 106 (not visible), releasing the collected dust into the vacuum cleaner 108 (not visible).

FIG. 4C is a side view further illustrating the duster 100 of FIG. 3. The ergonomic shape of the handle 112 is clearly apparent in this view. An exhaust port 304 is also clearly visible, through which air is ejected after having been cleaned by the vacuum cleaner 108 from the dust that was collected and released by the rows 402 of brush fibers 208 as explained in the foregoing paragraph.

Figure 5:
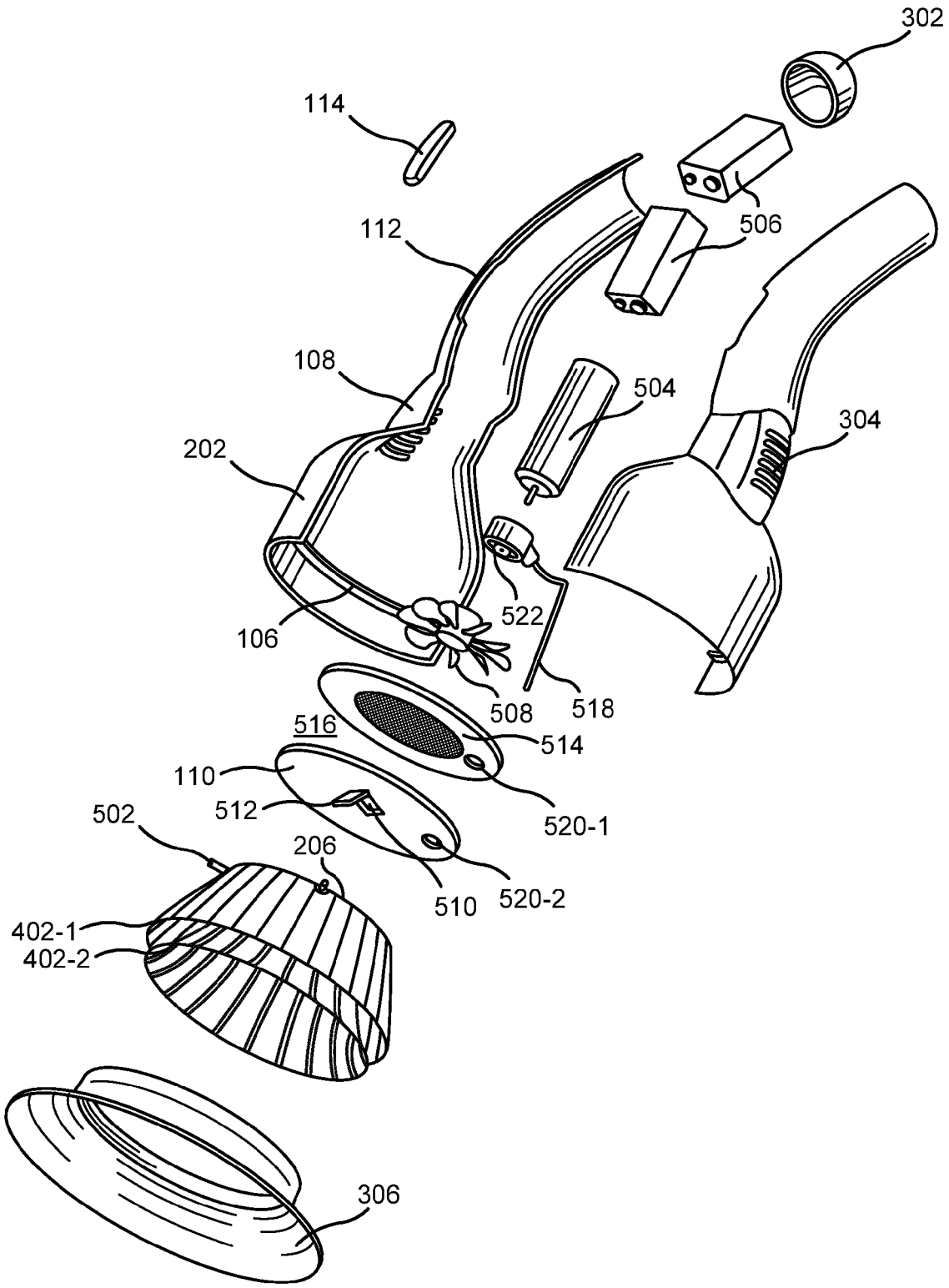
FIG. 5 is an exploded view further illustrating the duster of FIG. 3.

FIG. 5 is an exploded view further illustrating the duster 100 of FIG. 3. To avoid obscuring other features, only two rows 402-1 and 402-2 of brush fibers 208 are shown, but it should be understood than any number of rows 402 may be provided, emanating in all directions from the axle(s) 206, as supported by brackets 502.

Internal details of the vacuum cleaner 108 are visible, including a motor 504 powered by batteries 506 which drives a fan 508. The fan 508 draws air containing the collected dust through an aperture 510 in the intake port 110. A self-closing flap 512 prevents the dust from escaping back through the aperture 510 when air is not flowing. In an embodiment, the flap 512 may rubber, spring-loaded, or the like. The air is further drawn through a filter 514 which captures the dust and allows only clean air to escape through the fan 508 and out the exhaust port 304. The space between the intake port 110 and the filter 514, further enclosed by the housing 202 when fully assembled, thereby forms a dust receptacle 516 that safely sequesters the collected dust from the cleaned environment.

Also visible in this view is an embodiment of the scraping edge 106, here shown as an integral feature of the housing 202. When assembled, the dust receptacle 516 resides behind the scraping edge 106, such that the dust scraped off of the inward-rotating rows 402 of brush fibers 208 can thus be released to be drawn through the aperture 510. In an embodiment, the intake port 110 may be periodically removed to allow the dust receptacle 516 to be emptied, and the filter 514 to be removed for cleaning or replacement.

In addition to driving the fan 508 of the vacuum cleaner 108, the motor 504 may also drive the axle(s) 206 via a flexible drive shaft 518, routed through guide holes 520 to hold it in position. Different rotational speeds for the axle(s) 206 and the fan 508 may be achieved by means of a driver gear box 522 to gear the one down, to overdrive the other, or both. In another embodiment, a second motor (not shown) may be provided to drive the axle(s) 206.

Figure 6:
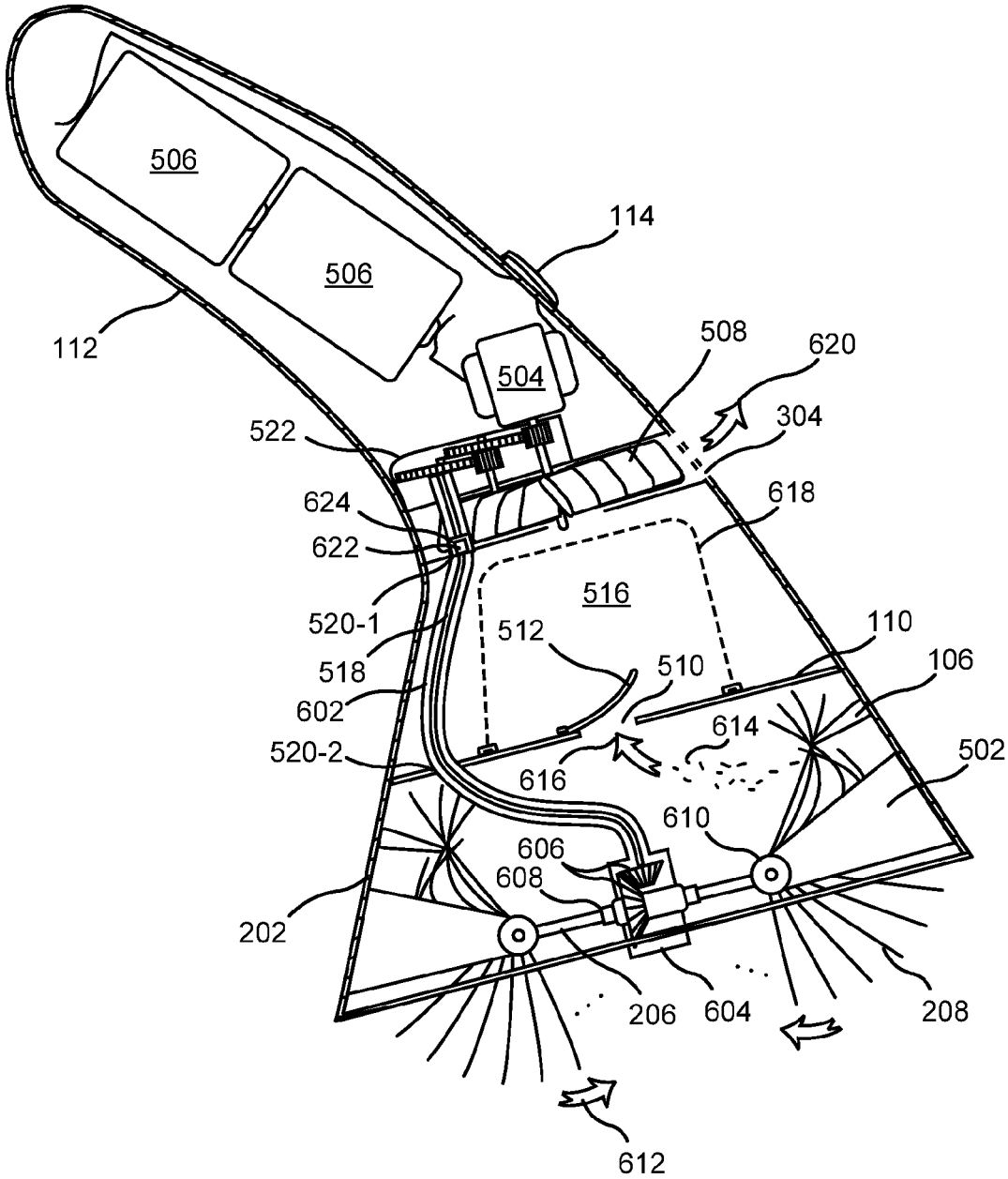
FIG. 6 is a cutaway side view illustrating one embodiment of a duster in accordance with the present invention.

FIG. 6 is a cutaway side view illustrating one embodiment of a duster 100 in accordance with the present invention. In this embodiment, the fan 508 is driven directly by the motor 504, and the axle(s) 206 are driven by the flexible drive shaft 518 at a lower rate of rotation, being geared down through the driver gearbox 522 via a two-stage gear reduction as shown. In another embodiment, a greater or lesser gear ratio may be implemented. The flexible drive shaft 518 may be encased in a flexible sleeve 602 routed through the guide holes 520 to hold it in place. The sleeve 602 may help to ensure smooth rotation of the shaft 518, as well as prevent wear of the guide holes 520 and entanglement of the rotating brush fibers 208.

The flexible drive shaft 518 may drive the axle(s) 206 via a driven gearbox 604. A perpendicular junction between the drive shaft 518 and the axle(s) 206 may be achieved by the use of bevel gears 606 within the driven gearbox 604. The axle(s) 206 may connect to the driven gearbox 604 by means of an axle key 608 inserted into an axle key slot (not visible in this view). The axle(s) 206 may then rotate in bushings 610 mounted on the brackets 502 in an inward direction of rotation 612. The dust 614 is thus swept into the brush housing 202 and released as the brush fibers 208 rotate past the scraping edge 106. The dust 614 is then carried through the aperture 510 of the intake port 110 by the airflow in 616 into the dust receptacle 516.

In the embodiment shown, the dust receptacle 516 comprises a filter bag 618, which may be either disposable or cleanable and reusable. The filter bag 618 may have more surface area than the filter 514, thereby providing greater dust collection capacity and offering less airflow resistance. On the other hand, a reusable filter 514 may be more convenient, cost-effective, and environmentally "green" than a disposable filter bag 618. A number of factors and tradeoffs may thus influence the choice of the dust receptacle 516. In the embodiment shown, once the dust 614 has been sequestered into the filter bag 618, the fan 508 draws the clean airflow out 620 into the surrounding environment through the exhaust port 304.

In a further embodiment, the brush housing 202 may be detachable from the handle 112, providing access for replacement of the filter bag 618. A drive shaft key 622 that fits into a drive shaft key slot 624 may be provided to allow the flexible drive shaft 518 to disconnect from the driver gearbox 522 when the brush housing 202 is detached and reconnect when the brush housing 202 is reattached.

Figure 7A:
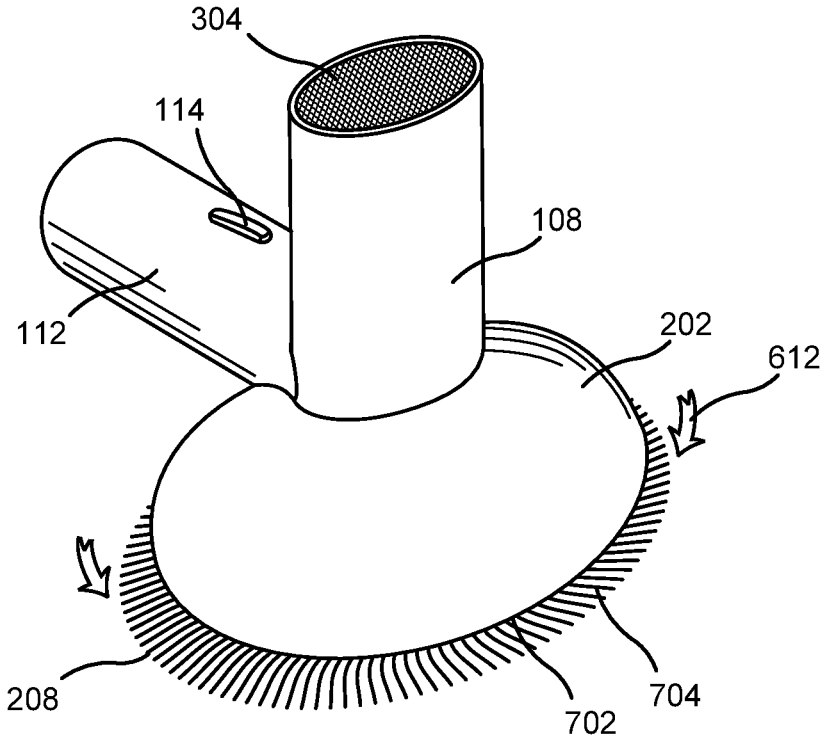
FIG. 7A is a perspective view illustrating one variant of a duster having a circular opening.

FIG. 7A is a perspective view illustrating one variant of a duster 100 having a circular opening 702. Brush fibers 208 of a curved brush 704 emanate from the substantially circular opening 702 in the brush housing 202, and rotate inward 612 so as to sequester the accumulated dust inside the housing 202. From there, the vacuum cleaner 108 further sequesters the dust, emitting only clean filtered air through the exhaust port 304. A handle 112 with a switch 114 is provided to easily operate the tool over the surface to be dusted.

A small vacuum cleaner 108 can generate sufficient suction, because the brush housing 202 is small and the opening 702 is partially obstructed by the brush fibers 208. Thus an airflow rate is maintained that is sufficient to clean the brush fibers 208 while not unduly retarding their inward rotation 612. The main purpose of the vacuum cleaner 108 is to clean the brush fibers 208 and sequester the removed dust, not to remove the dust directly from the household surface, which is the main purpose of the rotating brush fibers 208. Thus, a small, battery-powered vacuum cleaner 108 should be adequate for the purpose.

Figure 7B:
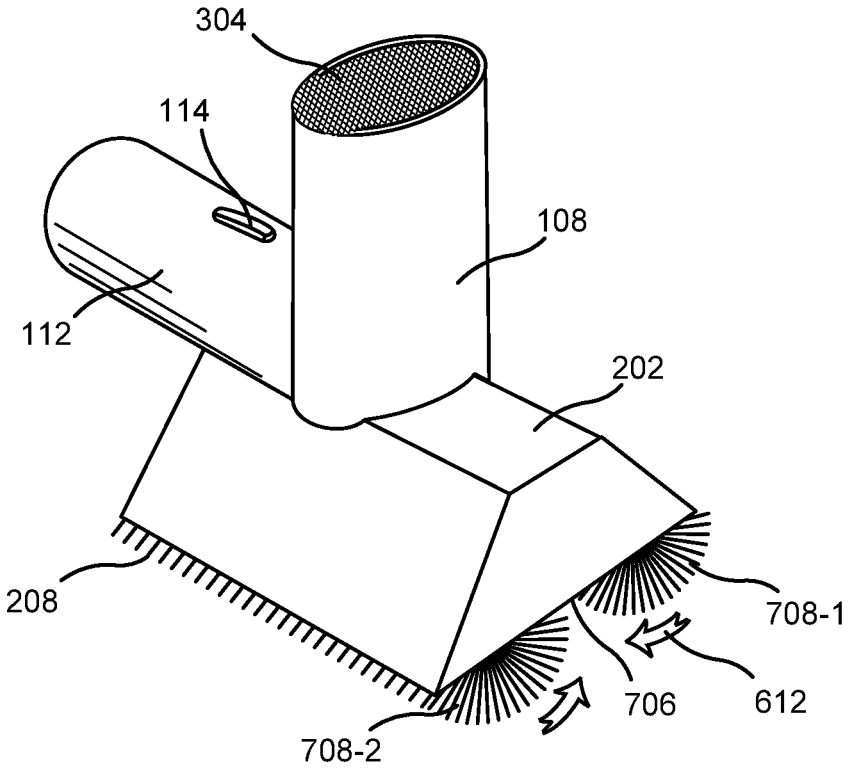
FIG. 7B is a perspective view illustrating another variant of the duster having a rectangular opening.

FIG. 7B is a perspective view illustrating another variant of the duster 100 having a rectangular opening 706 in the brush housing 202, with two straight brushes 708-1 and 708-2 rotating inward 612 in opposite directions. The brushes 708 are shown with an axis of rotation parallel to the handle 112, but they may be oriented in any direction. Any polygonal opening 204 with one or more pairs of brushes on substantially opposite sides of the opening 204 could likewise accomplish the desired purpose. To protect the household surface from damage, the outer perimeter of the opening 204 may be flexible, padded, or the like, if the brush fibers 208 themselves do not provide sufficient padding.

Figure 8:
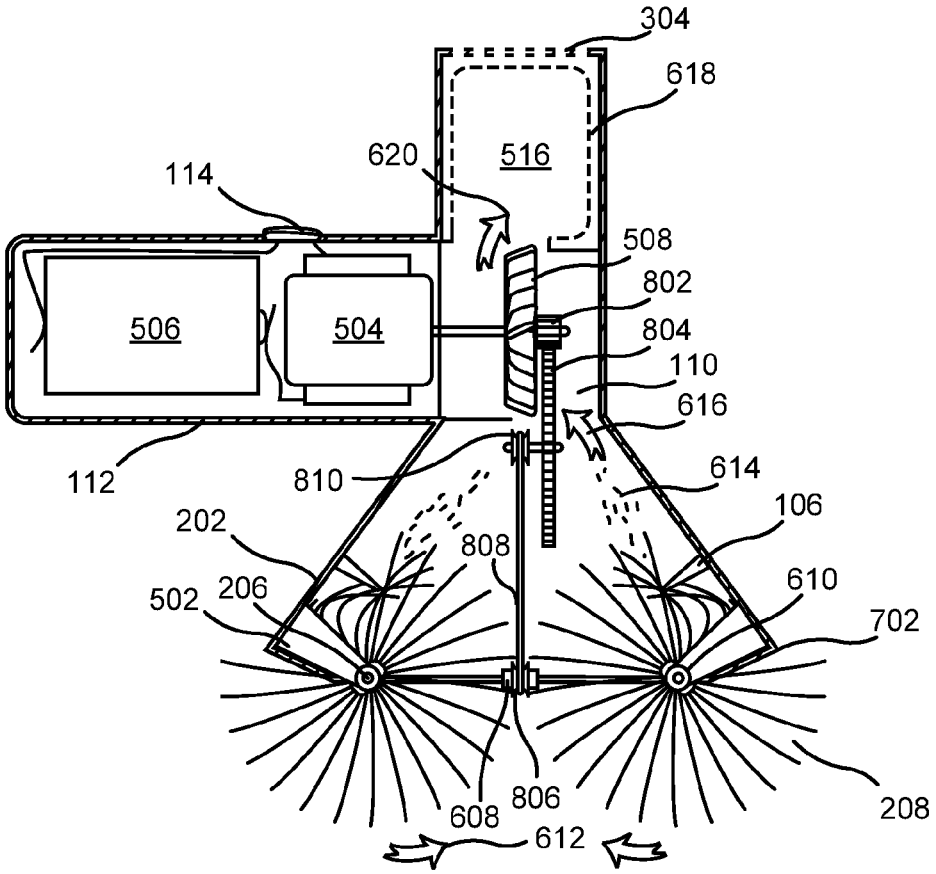
FIG. 8 is a cutaway side view further illustrating the duster of FIG. 7.

FIG. 8 is a cutaway side view further illustrating the duster 100 of FIG. 7, depicting another embodiment of an internal mechanism. The battery 506 and motor 504 may be housed in the handle 112, activated and deactivated by the switch 114. More than one battery 506 may be provided (not shown), and the battery or batteries 506 may or may not be replaceable or rechargeable. The motor 504 may directly drive the vacuum fan 508, and may indirectly drive the rotating brushes about the axles 206 through a system of gears, pulleys, belts, and the like. As shown, a small driver gear 802 driven directly by the motor 504 may engage a larger driven gear 804. The resulting gear reduction provides lower rotational speed and greater power for the brushes about the axle(s) 206 as compared with the higher speed of the vacuum fan 508.

The rotation of the brushes may be accomplished with one or more axles 206 from which the brush fibers 208 emanate, with the axle(s) 206 disposed around the inside perimeter of the opening 702 in the brush housing 202 through the bushings 610 mounted on the brackets 502. The axle rotation may be accomplished by inserting an axle key 608 at the end(s) of the axle(s) 206 into an axle key slot (not visible in this view) in a driven pulley 806 that is driven by a belt 808 from a driver pulley 810 mounted on the same shaft as the large driven gear 804. In a further embodiment, a shroud (not shown) may be provided to protect the belt 808 and other internal moving parts and prevent entanglement of the brush fibers 208.

In another embodiment (not shown), a hand crank may be provided to drive the large driven gear 804, which in turn would drive both the vacuum fan 508 and the pulleys 806 and 808, thereby eliminating the need for the motor 504 and battery 506 or other source of electricity.

Farther inside the brush housing 202 is shown a brush scraper having a scraping edge 106 disposed around the circumference of the housing 202. The brush fibers 208 bend as they rotate past the brush scraper 106, scraping off the dust particles 614 and ejecting them into the interior of the brush housing 202. In a further embodiment (not shown) the scraping edge 106 may be serrated, scalloped, or the like, so as to increase its effective length and its degree of contact with the brush fibers 208 as they rotate past it. The vacuum fan 508 creates an airflow in 616, drawing the dust particles 614 through the intake port 110 into the porous filter bag 618. The airflow out 620 passes through the exhaust port 304 with the dust particles 614 having been filtered out by the filter bag 618. Thus the dust particles 614 have been cleaned off of the brush fibers 208 and sequestered in the filter bag, with only clean filtered air being returned to the household environment. In this embodiment, the filter bag 618 is shown downstream of the fan 508, propelling the airflow out 620 into and through the filter bag 618. An advantage of this configuration may be easier access to the filter bag 618 to empty, clean and/or replace it. A disadvantage may be that the dust 614 comes into contact with the internal moving parts including the fan 508.

The side view as shown in FIG. 8 assumes a flexible circular axle 206 disposed around the substantially circular opening 702 in the brush housing 202 with an axle key 608 at either end inserted into the driven pulley 806. A similar configuration could be used for the substantially rectangular opening 706. In that case (not shown), the side view of the brush housing 202 would be rectangular, the axle(s) 206 would be rigid and straight, running the length of the housing 202, and the shaft holding the driven gear 804 and driver pulley 810 would also run the length of the housing, with a driver pulley 810 at each end.

Figure 9:
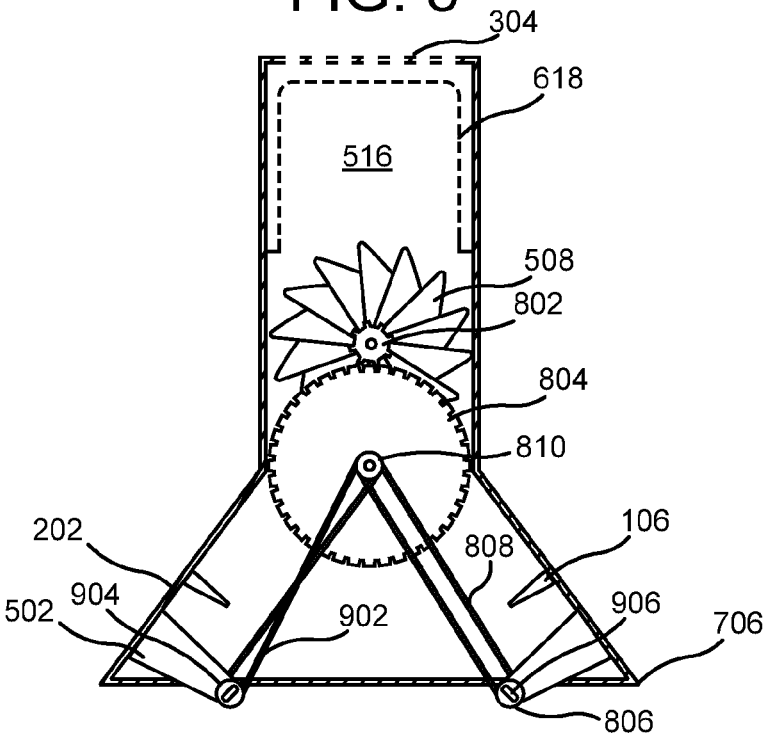
FIG. 9 is a cutaway front view further illustrating the duster of FIG. 7.

FIG. 9 is a cutaway front view further illustrating the duster 100 of FIG. 7, depicting a configuration of belts and pulleys that could apply to a brush housing 202 having a rectangular opening 706. In addition to the belt 808 and driven pulley 806 as already seen, a reverse belt 902 and reverse driven pulley 904 may also be provided. The reverse belt 902 is mounted with a single twist so as to drive the reverse driven pulley 904 in a direction opposite to the driven pulley 806. Driven pulley 806 may drive straight brush 708-1 and reverse driven pulley 904 may drive straight brush 708-2 in an opposing direction.

Alternatively, the same configuration as shown could drive two flexible semicircular axles 206 in the case of a circular opening 702. In the case of a single flexible circular axle 206, only one driven pulley 806 would be required. Axle key slots 906 in the driven pulleys 806 and 904 are visible in this view, into which the axle key 608 at one or both ends of the axle(s) 206 may be inserted. Other means of affixing the axle(s) 206 to the driven pulley(s) 806 (and 904) may be used, such as a set screw or the like.

Figure 10A:
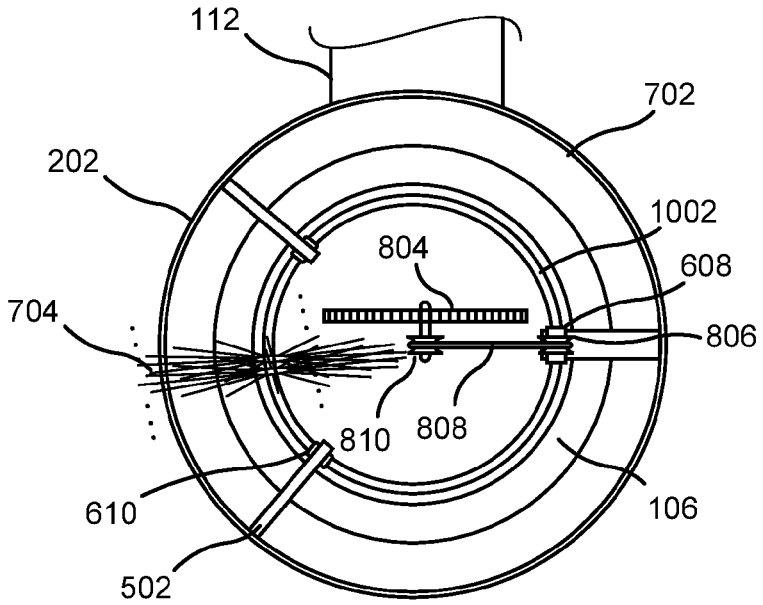
FIG. 10A is a cutaway bottom view further illustrating the duster variant having the circular opening of FIG. 7A.

FIG. 10A is a cutaway bottom view further illustrating the duster 100 variant having the circular opening 702 of FIG.

7A. The circular opening 702 is shown with a single driven pulley 806 and a single flexible axle 1002 that bends in a complete circle with an axle key 608 at each end that may be inserted into the axle key slot 906 (not visible in this view) on either side of the driven pulley 806. Two bushings 610 are shown, which may be snapped into or otherwise affixed to the corresponding brackets 502, completing the installation of the curved brush 704. A different number of bushings 610 and brackets 502 could also have been used.

Alternatively, two semicircular flexible axles (not shown) could have been used in conjunction with a reverse driven pulley 904. The axle key 608 at one end of each semicircular axle would be inserted into the axle key slot 906 on either side of the driven pulley 806, and the axle key 608 at the other end of each semicircular axle would be inserted into the axle key slot 906 on either side of the reverse driven pulley 904. One or more bushings 610 and brackets 502 could be disposed between the driven pulley 806 and reverse driven pulley 904, such as at the midpoint. More generally, an arbitrary number of driven pulleys 806 and flexible axles 206 of the appropriate arc length could be used, with bushings 610 and brackets 502 as needed to support the flexible axles 206.

Figure 10B:
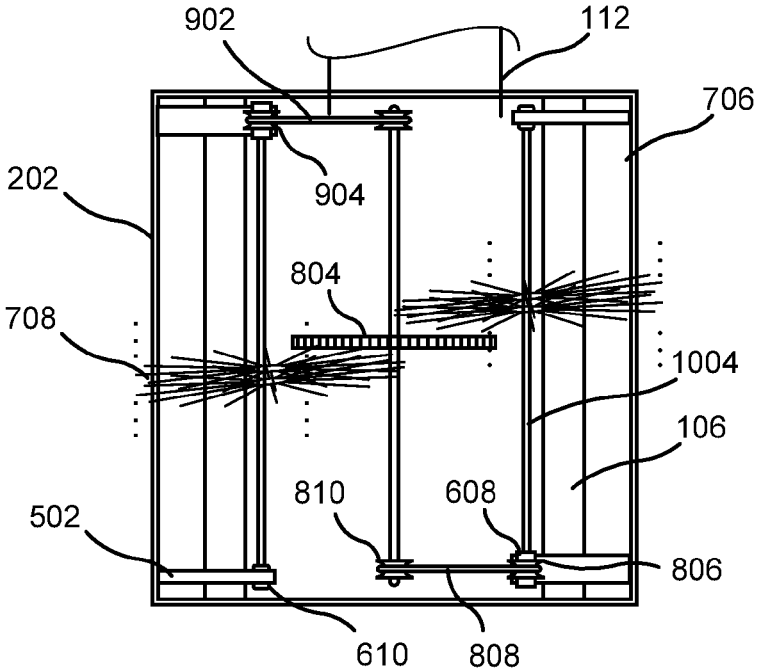
FIG. 10B is a cutaway bottom view further illustrating the duster variant having the rectangular opening of FIG. 7B.

FIG. 10B is a cutaway bottom view further illustrating the duster 100 variant having the rectangular opening 706 of FIG. 7B. The rectangular opening 706 is shown with both a driven pulley 806 and a reverse driven pulley 904. Two rigid axles 1004 may be provided, with the axle key 608 at one end of each axle 1004 inserted into the axle key slot 906 (not visible in this view) of the driven pulley 806 and of the reverse driven pulley 904, and a bushing 610 at the other end of each axle 1004 snapped into the corresponding bracket 502, completing the installation of the opposing straight brushes 708. More generally, an arbitrary number of driven pulleys 806 and rigid axles 206 of the appropriate length could be disposed around the inside perimeter of an arbitrary polygonal opening 204, with bushings 610 and brackets 502 as needed to support the rigid axles 206.

Figure 11:
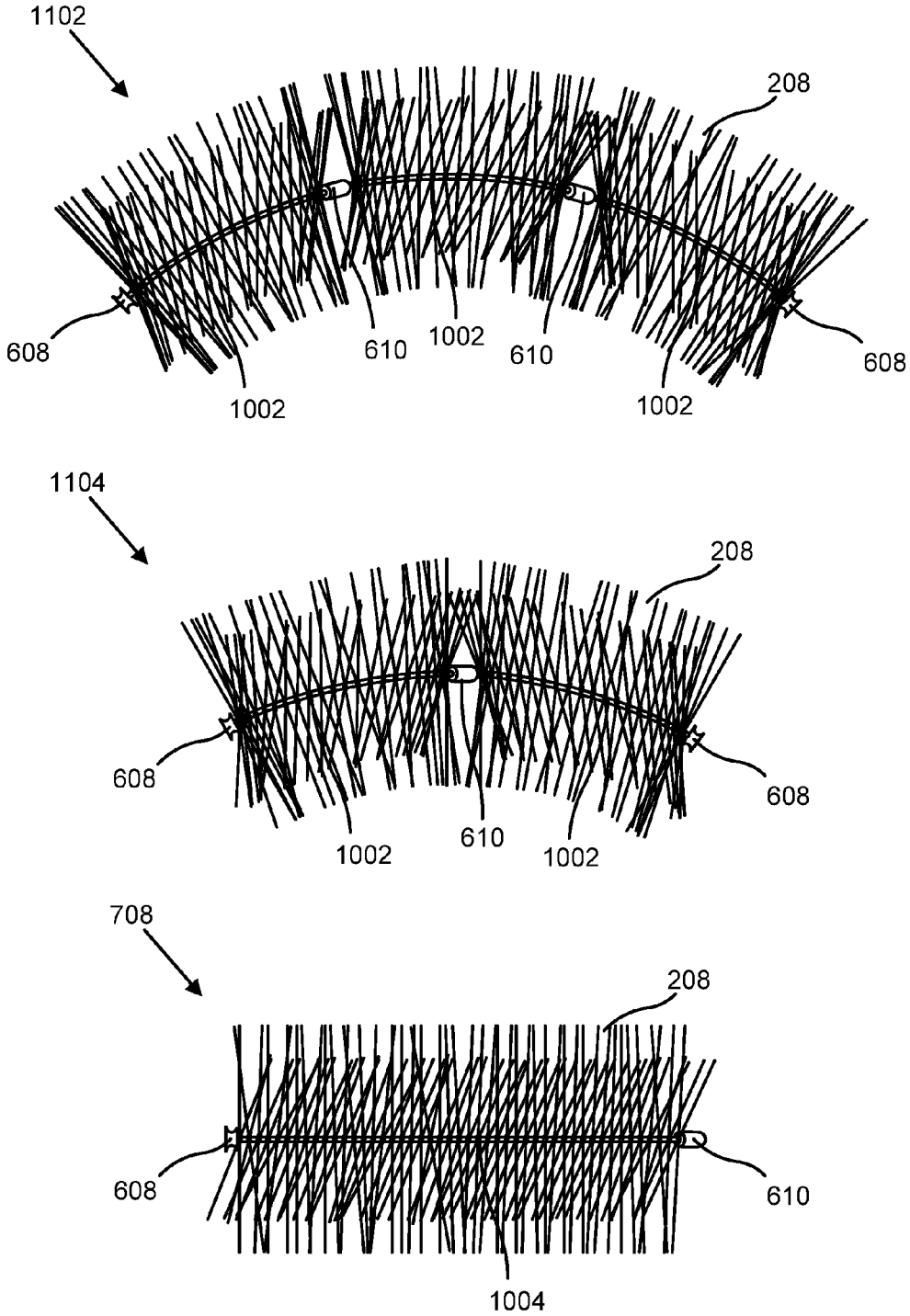
FIG. 11 is an illustration of various brush configurations.

FIG. 11 is an illustration of various brush configurations, including a circular brush 1102, a semicircular brush 1104, and a straight brush 708. The insertable axle keys 608 and snap-together bushings 610 and brackets 502 facilitate the easy removal and reinstallation of the brushes for cleaning or replacement. For greater ease and lower cost of manufacturing, standard interchangeable parts may be provided, including flexible axles 1002 and rigid axles 1004 with brush fibers 208, axle keys 608, and bushings 610. These parts may then be assembled in a predetermined sequence to produce the various types of replacement brushes as shown. For example, the circular brush 1102 may be produced by assembling an axle key 608, a flexible axle 1002, a bushing 610, a flexible axle 1002, a bushing 610, a flexible axle 1002, and an axle key 608. The semicircular brush 1104 may be produced by assembling an axle key 608, a flexible axle 1002, a bushing 610, a flexible axle 1002, and an axle key 608. The straight brush 708 may be produced by assembling an axle key 608, a rigid axle 1004, and a bushing 610. Similarly, many other sizes and configurations of replacement brush assemblies are possible.

Different types of brush fibers 208 may also be used, suitable for dusting different kinds of surfaces or providing a range of choices to the customer in terms of price, quality and other characteristics. Types of brush fibers 208 may include microfibers, electrostatic fibers, polyester fibers, wool fibers, feathers, other natural and synthetic fibers, and so forth.

Figure 12:
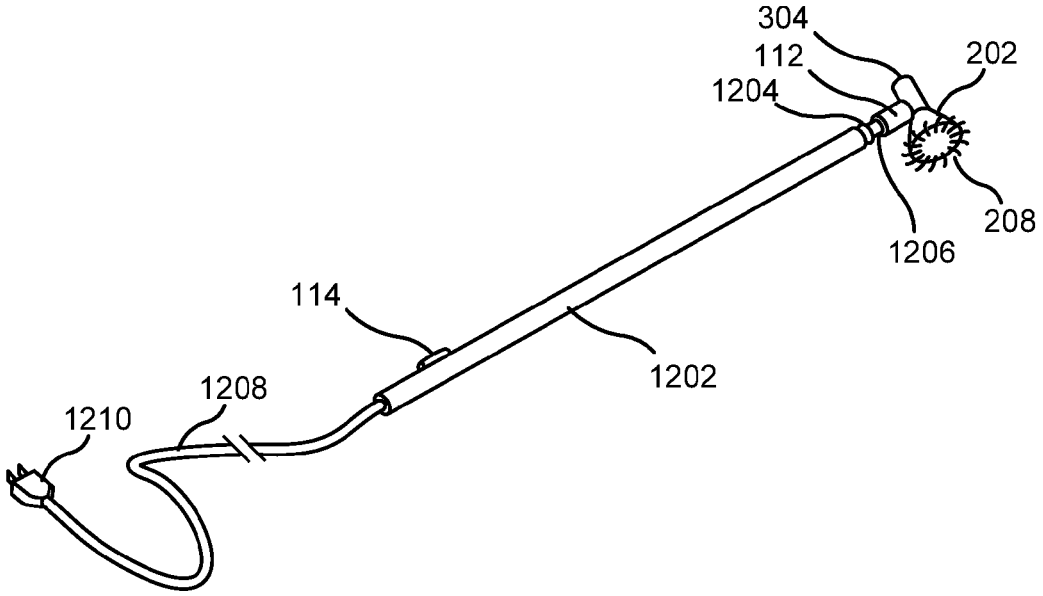
FIG. 12 is an illustration of a handle extension of a duster according to the present invention.

FIG. 12 is an illustration of a handle extension 1202 of a duster 100 according to the present invention. For example, the handle extension 1202 may used for removing dust from hard-to-reach surfaces such as crown molding. The handle extension 1202 may be telescoping to provide different lengths as needed. A standard ACME threaded attachment 1204 may be provided, which would also allow existing household accessories such as a removable broom handle and the like to be used as well. A swivel joint 1206 may be provided at the point of attachment to allow the duster 100 to be properly positioned to address the surface to be dusted. An electric cord 1208 and plug 1210 may be provided to supply power to the dust remover through the handle extension, with a switch 114 on the handle extension 1202 for convenient operation. An AC adapter (not shown) may be incorporated into the handle 112 or the handle extension 1202 to provide DC power for the motor 504 and/or a rechargeable battery 506.

Figure 13:
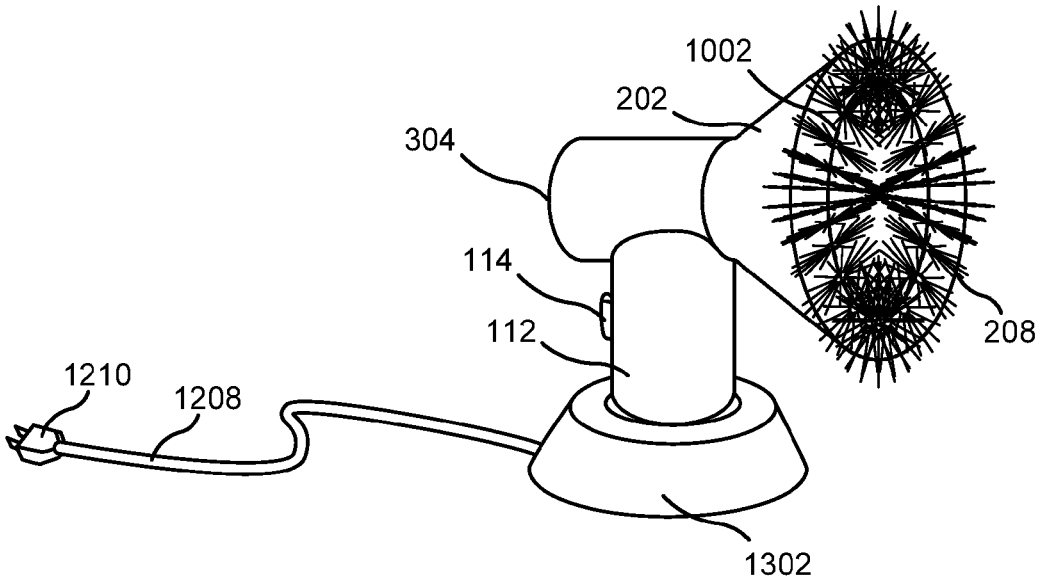
FIG. 13 is an illustration of a charger stand of a duster according to the present invention.

FIG. 13 is an illustration of a recharging fixture 1302 of a duster 100 according to the present invention. A recharging fixture 1302, such as the charger stand shown, may be provided in conjunction with a rechargeable battery 506 in the handle 112. The recharging fixture 1302 may also be mountable on a wall or other surface, usable within a vehicle, and so forth. A replaceable rechargeable battery 506 that may be removed from the handle 112 and placed in a separate recharging fixture 1302 may also be provided. In addition, the handle 112 may be configured to accept either the replaceable rechargeable battery or a standard disposable battery 506 such as a flashlight battery. If an AC adapter were incorporated into the handle 112, then only an electric cord 1208 of the same type as might be incorporated into the handle extension 1202 as described above would be required for powering and/or recharging the duster 100.

Figure 14:
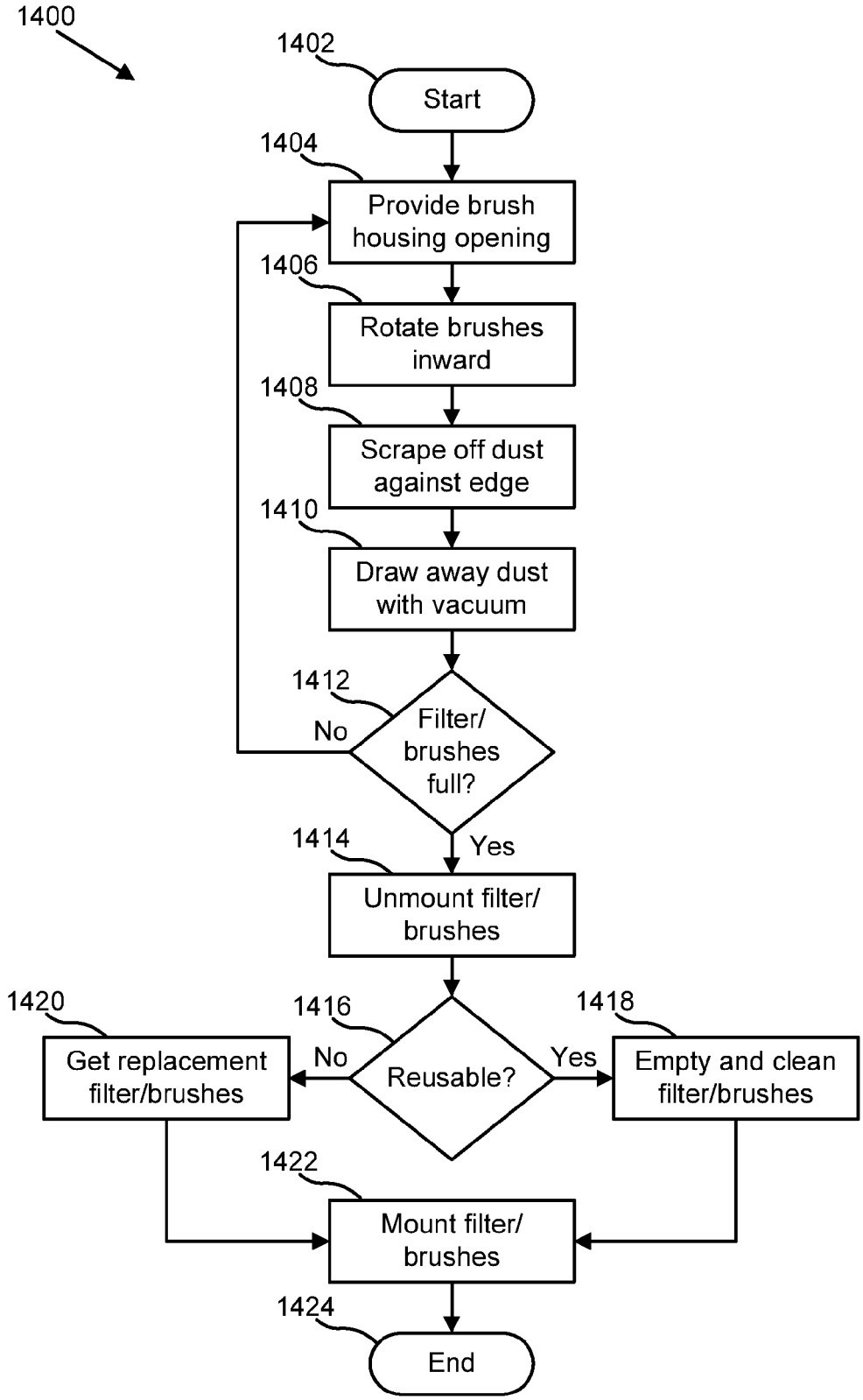
FIG. 14 is a schematic flow chart diagram illustrating one embodiment of a method for self-cleaning handheld dust removal in accordance with the present invention.

FIG. 14 is a schematic flow chart diagram illustrating one embodiment of a method 1400 for self-cleaning handheld dust removal in accordance with the present invention. The method 1400 starts 1402 and provides 1404 a brush housing 202 having an opening 204, one or more axles 206 disposed around the opening 204 inside the brush housing 202, and a plurality of brush fibers 208 emanating from the one or more axles 206 through the opening 204. The plurality of brush fibers 208 are rotated inward 1406 about the one or more axles 206 into the opening 204. Dust 614 is scraped 1408 off of the brush fibers 208 as they rotate inward 612 against a scraping edge 106 disposed around the opening 204 farther inside the brush housing 202 than the one or more axles 206. As the brush fibers 208 rotate inward 612, the dust 614 is drawn away 1410 from off and about the brush fibers 208 through a vacuum cleaner 108 intake port 110 into a dust receptacle 516 comprising a filter 514, a filter bag 618, or the like. If the dust receptacle 516 including the filter 514 or 618 is full 1412 and/or the brush fibers 208 are excessively caked with dust 614, then the filter 514 or 618 and/or brushes 704 or 708 may be unmounted 1414. Otherwise, the method 1400 continues, utilizing the dust remover 100 features as provided 1404 above. If the filter 514 or 618 and/or brushes 704 or 708 are reusable 1416, then they may be emptied and/or cleaned 1418. Otherwise they are replaced 1420 with a new filter 514 or 618 and/or brushes 704 or 708. The appropriate filter 514 or 618 and/or brushes 704 or 708 are mounted 1422 back in the dust remover 100 and the method 1400 ends 1424.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a brush housing having an opening, wherein the opening has a substantially circular shape;

one or more axles disposed around a perimeter of the opening in the brush housing, wherein the one or more axles are flexible and conform to the circular shape of the opening in one or more arcs; and a plurality of brush fibers emanating from the one or more axles that rotate inward toward opposing brush fibers that rotate inward in an opposite direction about the one or more axles into the opening.

2. The apparatus of claim 1, further comprising a scraping edge, disposed around the opening, farther into the brush housing than the one or more axles, that scrapes dust off of the brush fibers as they rotate inward against the scraping edge.

3. The apparatus of claim 1, further comprising a vacuum cleaner intake port inside the brush housing that draws dust from off and about the brush fibers as they rotate inward.

4. The apparatus of claim 1, wherein the one or more axles comprise two substantially semicircular axles.

5. The apparatus of claim 1, wherein the one or more axles comprise a single substantially circular axle.

6. The apparatus of claim 1, wherein the brush fibers are selected from the set consisting of microfibers, electrostatic fibers, polyester fibers, wool fibers, and feathers.

* * * * *